US007090157B2

(12) United States Patent
Peterson et al.

(10) Patent No.: US 7,090,157 B2
(45) Date of Patent: Aug. 15, 2006

(54) MATERIAL REDUCING APPARATUS

(75) Inventors: Arnold Neil Peterson, Eugene, OR (US); Glenn Ford Bittrolf, Springfield, OR (US); Lynn Roger Humphreys, Springfield, OR (US)

(73) Assignee: Peterson Pacific Corp., Eugene, OR (US)

( * ) Notice: Subject to any disclaimer, the term of this patent is extended or adjusted under 35 U.S.C. 154(b) by 130 days.

(21) Appl. No.: 10/804,781

(22) Filed: Mar. 19, 2004

(65) Prior Publication Data

US 2005/0205702 A1 Sep. 22, 2005

(51) Int. Cl.
*B02C 13/00* (2006.01)
*B02C 13/09* (2006.01)

(52) U.S. Cl. ..... 241/73; 241/189.1

(58) Field of Classification Search ..... 241/32, 241/73, 82, 97, 189.1
See application file for complete search history.

(56) References Cited

U.S. PATENT DOCUMENTS 953,111 A 3/1910 Williams
RE17,120 E 10/1928 Keith
1,776,593 A 9/1930 Meyer
1,816,097 A 7/1931 Sumner
2,305,159 A * 12/1942 Heckman et al. ..... 460/106
4,318,512 A * 3/1982 Jacobson et al. ..... 241/73
4,385,732 A * 5/1983 Williams ..... 241/236
4,773,601 A 9/1988 Urich et al.
4,813,620 A * 3/1989 Engelmohr et al. ..... 241/82
4,836,457 A * 6/1989 Greiner ..... 241/73
5,213,273 A * 5/1993 Linnerz ..... 241/73
5,265,811 A 11/1993 Willibald
5,273,218 A * 12/1993 Burns ..... 241/32
5,417,375 A 5/1995 Peterson et al.
5,472,146 A 12/1995 Doppstadt
5,743,472 A * 4/1998 Williams et al. ..... 241/32
5,947,395 A 9/1999 Peterson et al.
6,910,647 B1 * 6/2005 Alford et al. ..... 241/73

* cited by examiner

*Primary Examiner*—Faye Francis
(74) *Attorney, Agent, or Firm*—Schwabe, Williamson & Wyatt, P.C.

(57) ABSTRACT

A material reduction apparatus for reducing materials having an admixture that resists reduction. The mechanism incorporated into the apparatus to provide a bypass of such admixture while avoiding shut down interruption of the materials reduction operation.

8 Claims, 6 Drawing Sheets

MATERIAL REDUCING APPARATUS

FIELD OF THE INVENTION

This invention relates to a machine or apparatus for use in reducing material, e.g., for reducing material resulting from structural demolition to enable a more convenient transportation and disposal of such materials.

BACKGROUND OF THE INVENTION

A similar type of machine used for reducing wood and green waste material is disclosed in the commonly owned U.S. Ser. No. 10/225,714. The machine of that patent utilizes a rotor with projections referred to as hammers. Wood materials are conveyed along a path toward the rotating rotor and are first compressed by a compression roller which directs the material against the rotor. The rotor rotates to direct the material up and over the rotor into an overlying fixed anvil or anvil bar located in close proximity to the hammers and thereby to break the materials into smaller sized chunks of material. The thereby reduced material is forced along and through a series of screens which further reduce the material size. The material is deposited on a conveyor and conveyed to a staging area for recycling, e.g., as groundcover.

One further aspect of note for the machine as described is the provision of a safety release. In the event that a non-wood material, such as a chunk of iron, gets mixed in with the wood and is directed into the rotor and thereafter against the anvil, the anvil is designed to pivot open upon the breaking of a shear pin resulting from the increased impact of the iron mass against the anvil. The operation is closed down and the shear pin is replaced. While the operation is thus interrupted, such occurrences are not frequent and the major components of the apparatus are safeguarded as a result of the shear pin breakage and pivotal mounting of the anvil.

Use of the same machine is not satisfactory for reducing materials, e.g., resulting from structural demolition. Whereas a non-reducible item is but a rare occurrence for reducing wood materials, it is a common occurrence among structural demolition, and operation interruptions of the kind where replacing shear pins for such occurrences is undesirable.

BRIEF DESCRIPTION OF THE INVENTION

Whereas reduction of demolition materials is desirable, it is not required that there be substantially no remaining large items amongst the resulting reduced product of the apparatus. Thus, those items that are not readily reduced can be permitted to bypass the reduction process and still achieve the objective of the reduction operation. Accordingly, the present invention provides a bypass feature whereby a large percentage of the items that resist reduction to the point where damage to the machine may occur, are diverted from the reduction process thus enabling the reduction operation to continue without the otherwise frequent shutdown of the operation. Hereafter such items are referred to as reduction-resistant material.

In a preferred embodiment of the invention, the anvil is provided with a pivotal resist member whereby oversized and reduction-resistant material causes release of the anvil when impacted by the reduction-resistant material which opens a bypass route for the reduction-resistant material followed by automatic return of the anvil to thereby instantly reestablish the reduction processing of material.

The invention will be more fully appreciated and understood upon reference to the following detailed description of a preferred embodiment of the invention having reference to the accompanying drawings.

DETAILED DESCRIPTION

Figure 1:
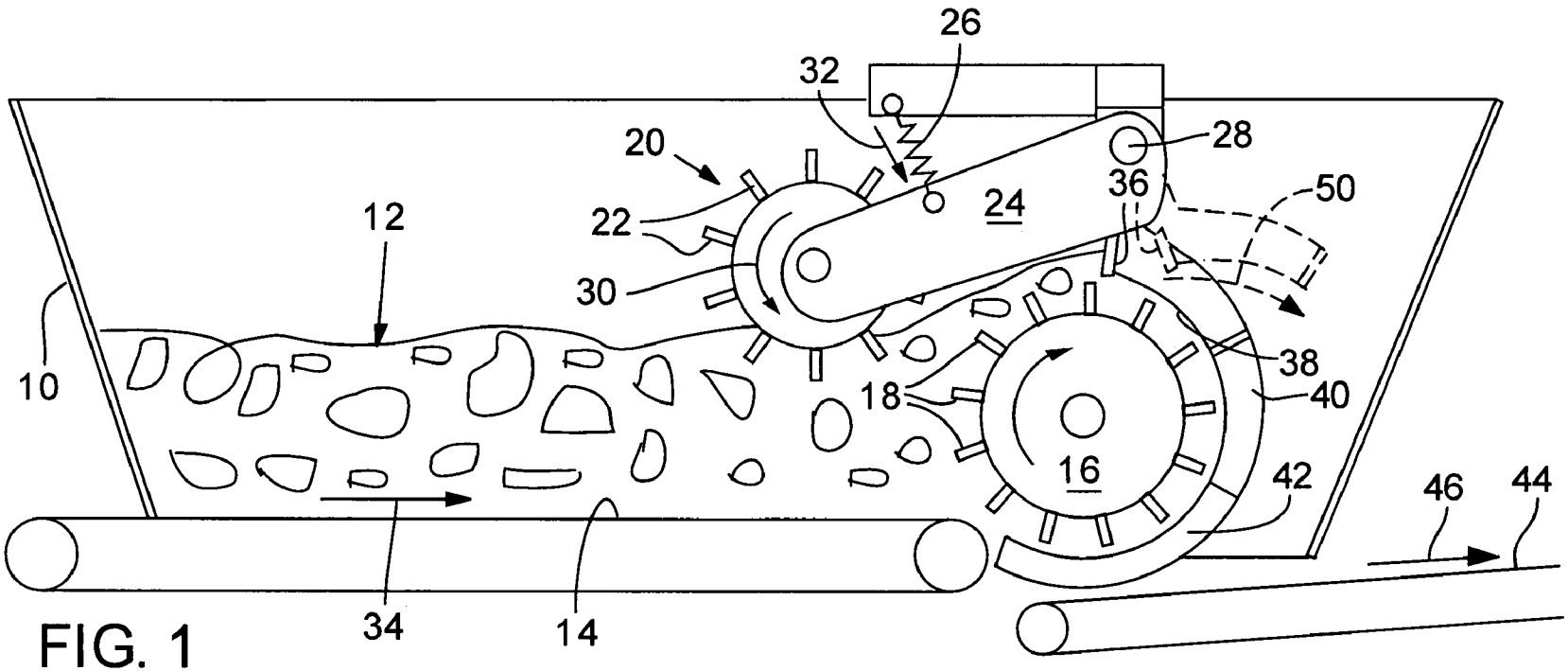
FIG. 1 is a schematic illustration of a materials reduction machine in accordance with present invention.

FIG. 1 schematically illustrates an embodiment of the present invention which includes a receiving bin 10 for receiving, e.g., structural demolition material 12. A conveyor 14 moves the material 12 toward a rotor 16 including radial projections referred to as hammers 18. A compression roller 20 includes ribs 22 mounted on a pivotal arm 24. A biasing member 26 between the arm 24 and the frame of the bin 10 urges the arm 24 and thus the roller 20 downward about shaft 28. The material 12 is thus urged downward and inward toward rotor 16 (arrows 30, 32).

Figure 1A:
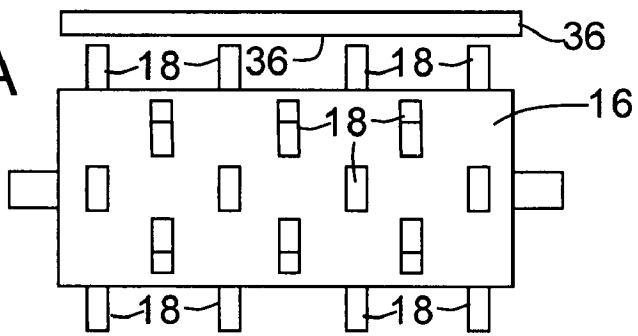
FIG. 1A is a front view of the rotor and anvil as used in the machine of FIG. 1.

As will be apparent from FIG. 1, the material 12 is forced against the rotating rotor (arrow 34) and carried upwardly and into engagement with stationary anvil 36. (See also FIG. 1A). Material that is too large to fit between the spacing provided between the hammers 18 and the anvil 36 are broken into pieces upon impacting anvil 36.

Following anvil 36 clockwise (as viewed in FIG. 1) around rotor 16 are three screen sections 38, 40, and 42. Material chunks 12, as reduced by anvil 36 and hammers 18, are then urged by the hammers against screens 38, 40 and 42 and further reduced. Material passing through the screens is deposited onto conveyor 44 and conveyed (arrow 46) to a staging site not shown. The materials not passed through the screens are recycled through the process as described, e.g., into the anvil and against the screens.

As described in the Brief Description above, the invention is directed to the inclusion of a bypass for reduction-resistant material 12. The mechanism for providing the bypass will be explained, having reference to further drawings and in general as viewed in FIG. 1 is enabled by mounting of the anvil 36 and screen 38 on a pivotal member pivoted about shaft 28 and which resistively permits pivoting as indicated by the dash line position of anvil 36 and screen 38 to create the bypass 50.

Figure 2:
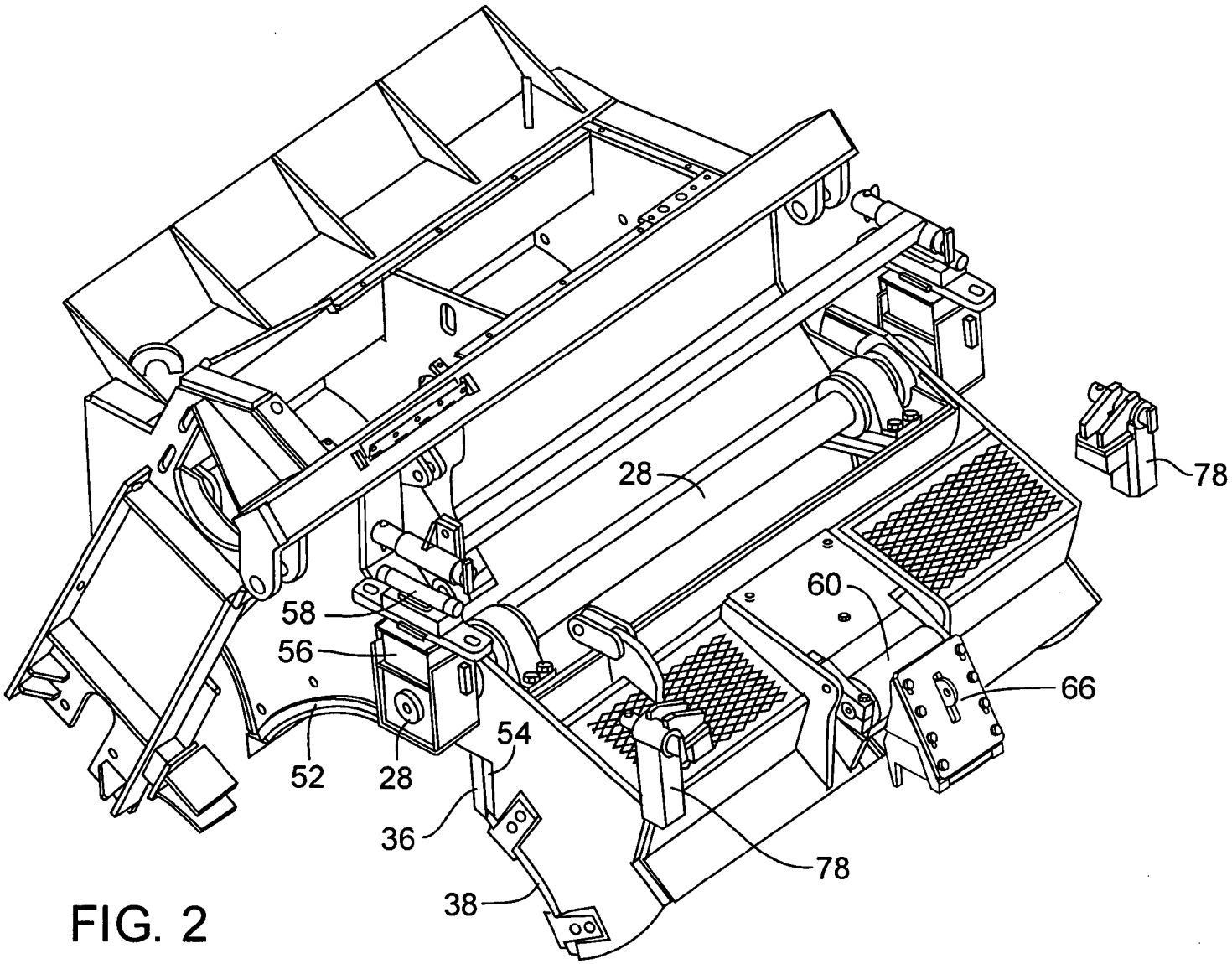
FIG. 2 is a pictorial view of certain of the components of the machine of FIG. 1.
Figure 3:
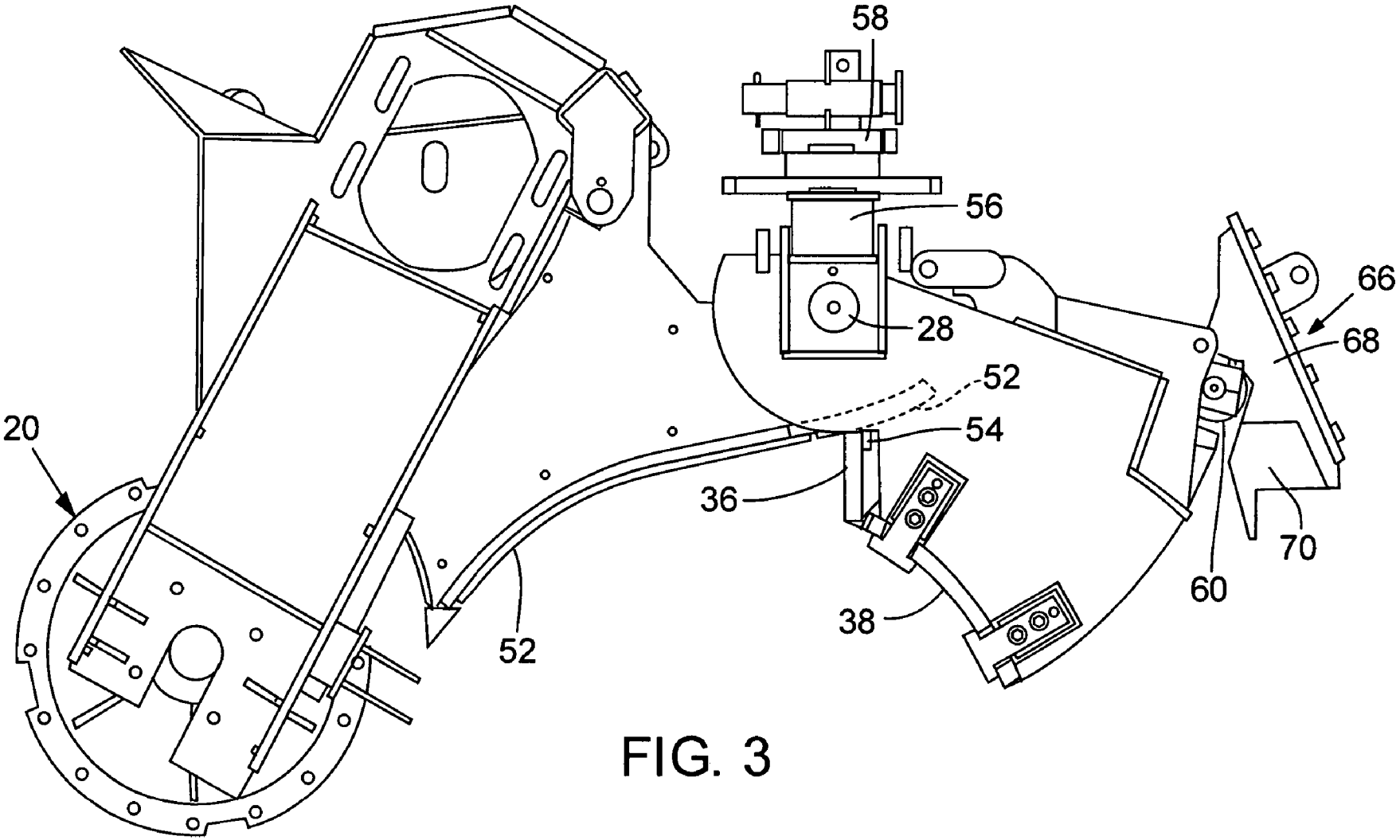
FIG. 3 is a side view of the components of FIG. 2.
Figure 4:
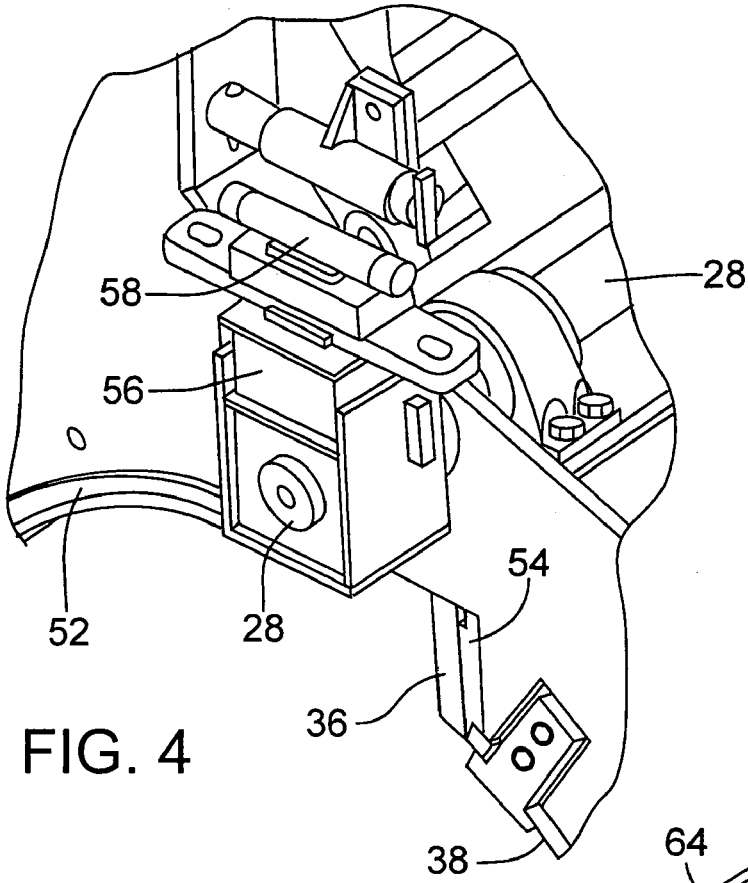
FIGS. 4, 5 and 5A show in greater detail certain of the release features of the machine of FIGS. 1–3.

Reference is now made to FIGS. 2, 3 and 4 which illustrate the general relationship as between the compression roller 20 and the pivotal anvil 36/screen 38. Both mechanisms are pivotally mounted to pivot shaft 28 and pivot independently about shaft 28. It will be appreciated that shield 52 captures material 12 being directed into the rotor 16 to force the material against anvil 36. In prior wood reducing versions, the two mechanisms were independently pivoted and pivoting of the anvil 36/screen 38 would open a gap to allow materials to flow between the mechanisms. In the illustrated embodiment of FIG. 3, the shield 52 is extended as shown in dash line in the form of a curve that coincides with the pivoting of the anvil 36/screen 38 mechanism. A wiper 54 maintains engagement with the curve to prevent material from passing between the anvil and shield during relative pivoting.

Seated above the shaft 28 is a compression pad 56 that permits limited upward movement of shaft 28 as a stress relief, e.g., when overloaded. Also observed in FIG. 3 is a shear pin 58 that is a safety provision in the rare occasion when a reduction-resistant material 12 exceeds the capability of the bypass feature of the invention, causing breakage of the shear pin and thus shut down and shear pin replacement.

Figure 5:
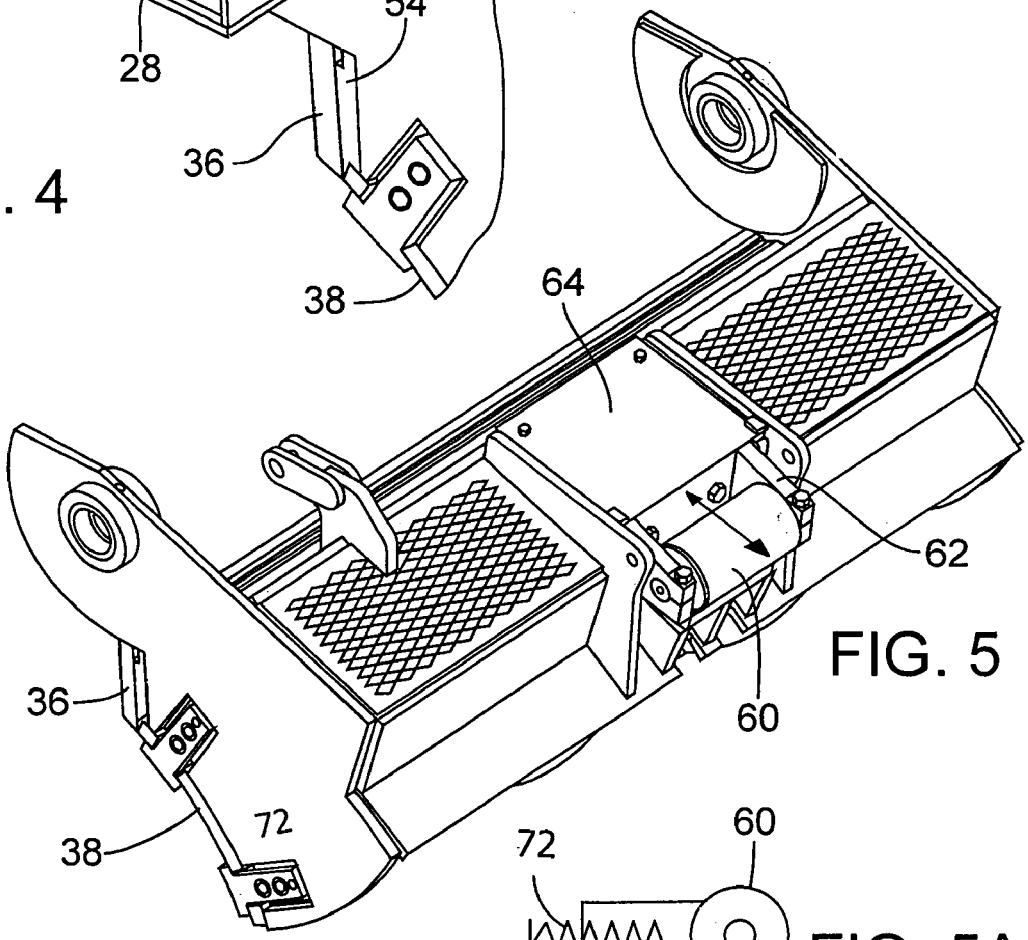
Figure 5A:
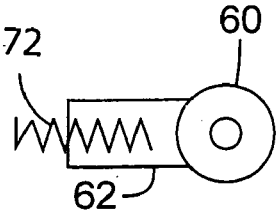

Reference is now made to the relatchable relief mechanism shown in FIGS. 2, 3 and 5. FIGS. 5 and 5A illustrate the anvil 36/screen 38 mechanism only. As shown, the mechanism includes a retractable cam member 60 that is mounted to a slide 62 that slides in and out of a pocket formed under plate 64. In various embodiments in accordance with the present invention, a material reducing apparatus may include a pivotal resist member. In various ones of these embodiments, a pivotal resist member may comprise a first biasing member. An example of a first biasing member in accordance with various ones of these embodiments may be a strong spring 72 seated in the pocket (see FIG. 5A) urging a cam member 60 to its extended position.

Figure 3A:
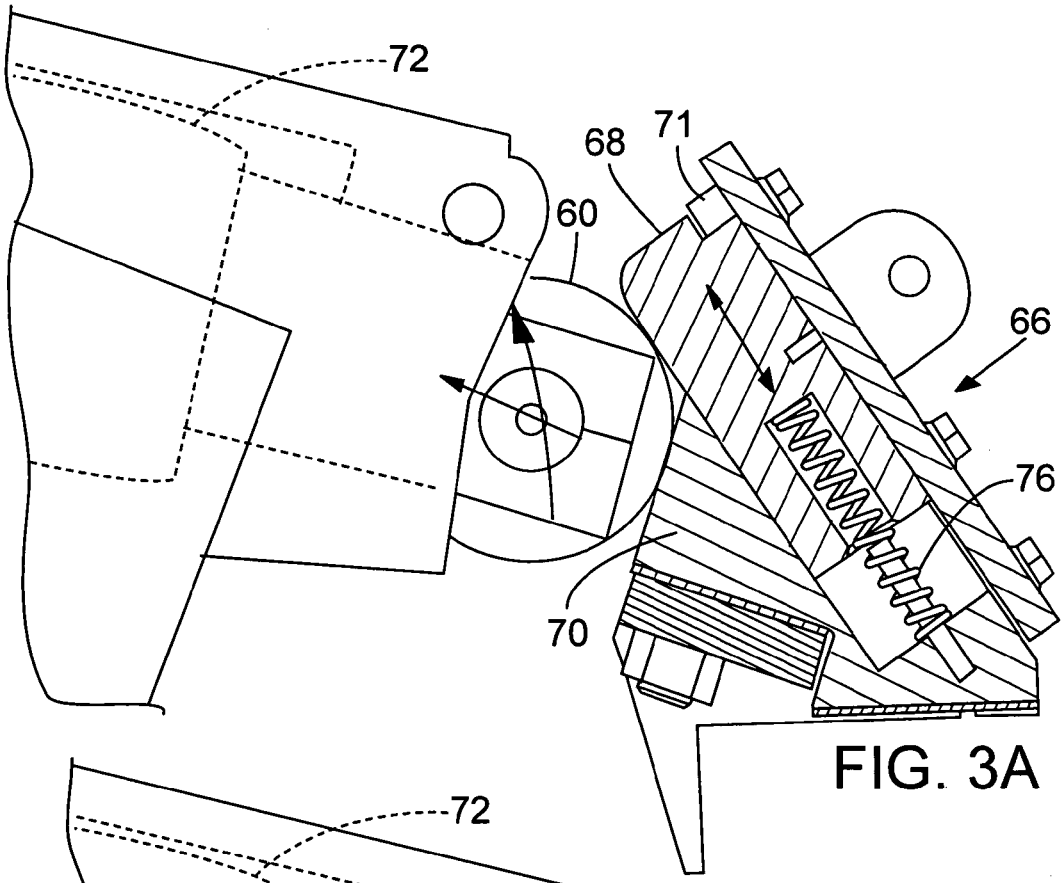
FIGS. 3A and 3B show in detail the breakaway features of the components in FIG. 3.
Figure 3B:
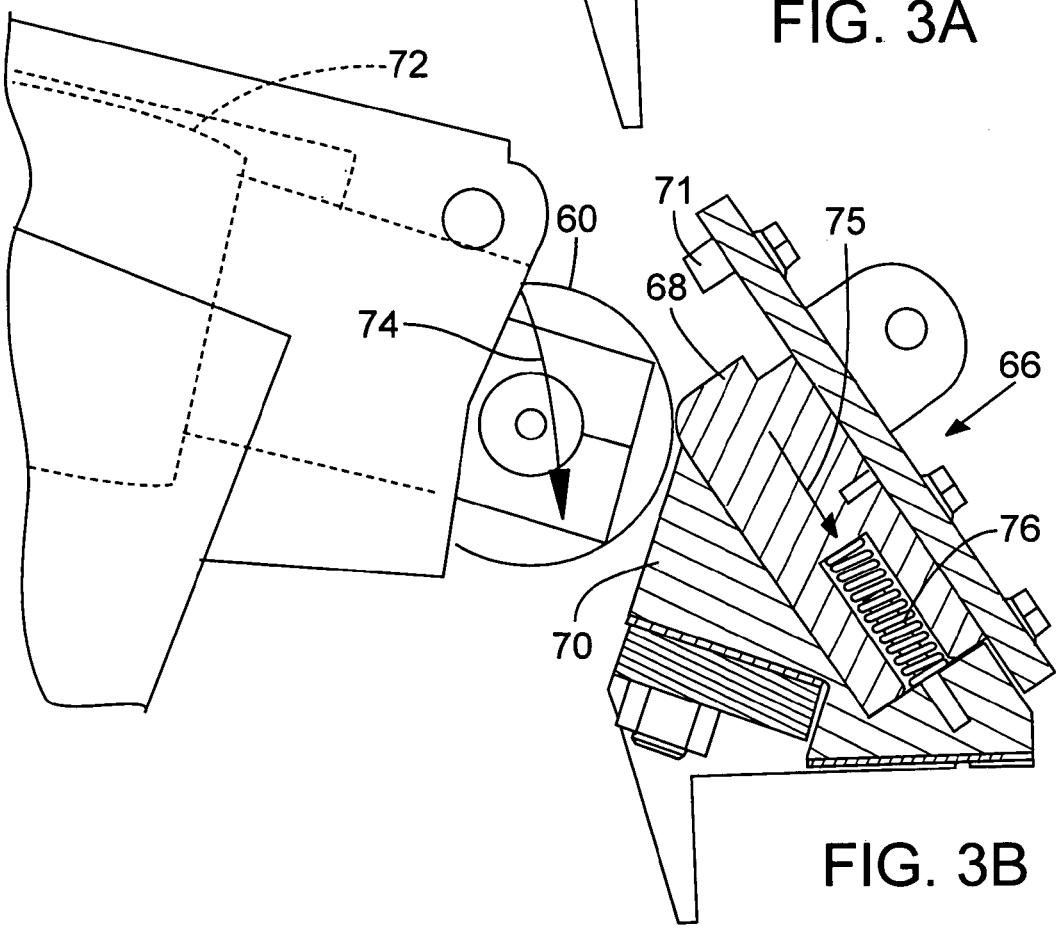

Referring now to FIGS. 2, 3A and 3B where a latch 66 is shown. Latch 66 is secured to the frame of the apparatus and, except for the retractable relatch mechanism, is fixed. As seen in FIGS. 3 and 3A, the cam member 60 is seated during normal operation in the cradle formed by a cam surface 68 and a latch body 70. In order for the anvil 36/screen 38 mechanism to pivot upwardly about pivot shaft 28, the cam member 60 has to retract. Note from FIG. 3A that the retractable cam surface 68 is not urged upwardly as the upward force component is normal to the movement of the slide. In any event, it is prevented from upward movement by stop 71. Thus, the strong spring 72 (FIG. 5A) has to be retracted in order for the latch mechanism to release. The spring 72 is provided with a desired force resistance to allow retraction only for severe reduction-resistive materials which can often be encountered when reducing demolition type materials.

It has been explained that the strong spring 72 does not readily accommodate relatching even though the weight of the machine is substantial and produces a significant relatching force. Thus, relatching is assisted by the provision of the cam surface 68. With reference to FIG. 3B, it will be observed that the relatching force indicated by arrow 74 forces inward sliding of cam surface 68 (see arrow 75) designed to accommodate the relatching force 74 to thereby allow the cam member 60 to slide past the cam surface 68 and return to the status of FIGS. 3 and 3A.

It has been explained that the strong spring 72 does not readily accommodate relatching even though the weight of the machine is substantial and produces a significant relatching force. Thus, relatching is assisted by the provision of the latch slide 68. With reference to FIG. 3B, it will be observed that the relatching force indicated by arrow 74 forces inward sliding of latch slide 68 (see arrow 75) designed to accommodate the relatching force 74 to thereby allow the roller 60 to slide past the slide 68 and return to the status of FIGS. 3 and 3A.

OPERATION

It will thus be apparent from the above that demolition materials are fed into the rotor 16 and reduced upon impact generated between the movement of the hammers 18 and the stationary anvil 36, the material then forced through any of the screens 38, 40 and 42 or recycled to repeat the reduction process. When a substantial/severe reduction-resistant material is encountered, the force impacted against the anvil 36 will result in forced retraction of cam member 60 and permit pivotal opening of the anvil 36 and screen 38 as illustrated in FIG. 1 in dash lines. Once the material passes through the bypass as thus provided (over the top of screens 40 and 42), the weight of the mechanism will urge the screen and anvil back to the latched position as permitted by a second biasing member 76. It will be observed from FIG. 2 that stop members 78 mounted to the frame of the apparatus limits the pivoting of anvil 36 and screen 38.

ALTERNATIVE EMBODIMENT

Figure 6:
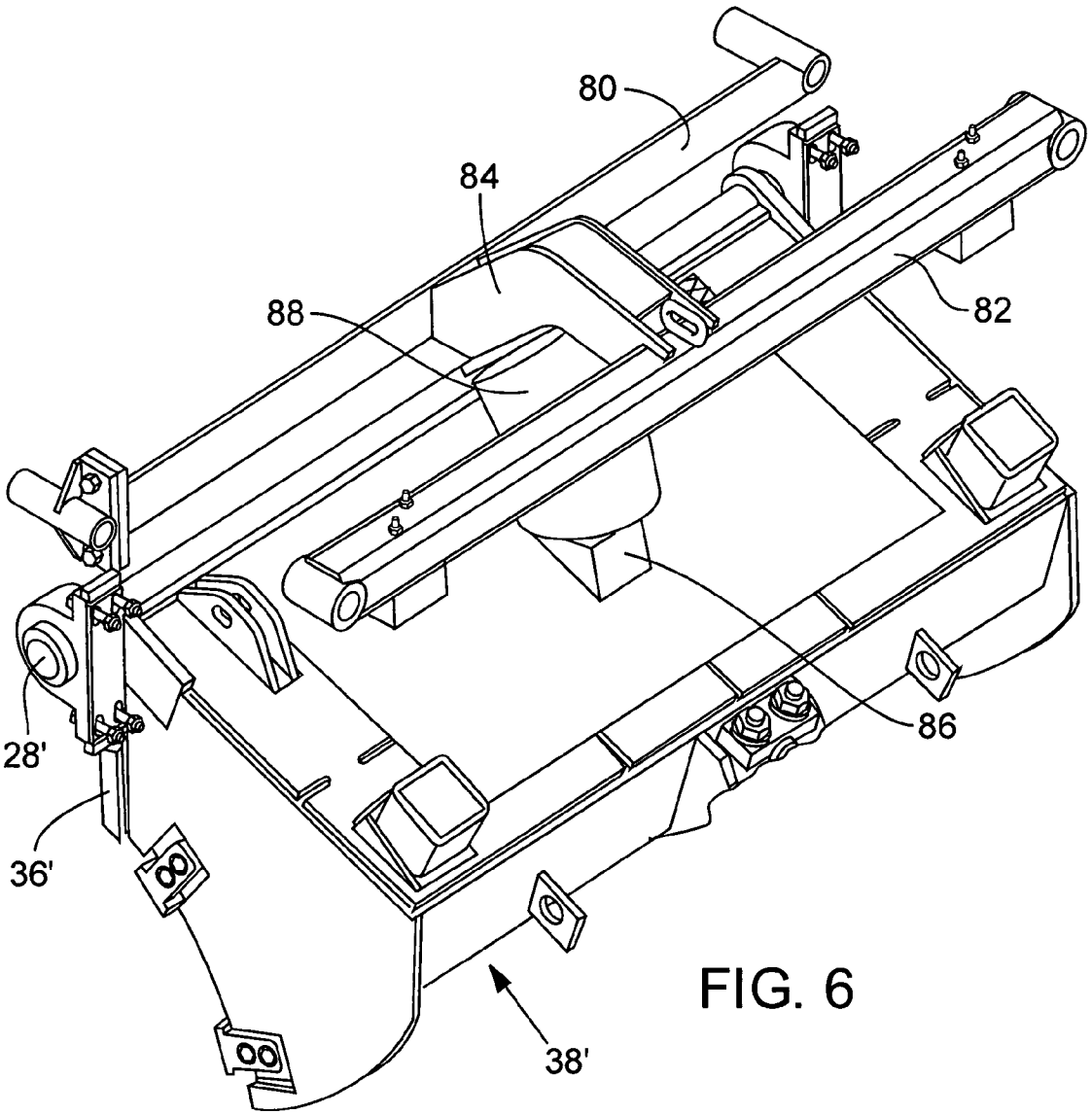
FIG. 6 illustrates an alternate embodiment of the invention.

FIG. 6 illustrates an alternative embodiment. Rigid frame members are indicated at reference numbers 80, 82. An upper support beam 84 is rigidly connected to the frame member 80, 82. A lower support 86 is secured to the top of screen section 38'. In various embodiments in accordance with this invention, a pivotal resist member may comprise an airbag. In various ones of these embodiments, airbag 88 (or other biasing member) fits between supports 84, 86 and resistively permits pivoting of screen section 38' and anvil 36' about shaft 28'.

The embodiment of FIGS. 1–5 operate to unlatch, permit free bypass and then relatches and is considered desirable for certain applications of demolition reduction. FIG. 6 allows pivoting while maintaining resistance. As the reduction resistant force increases, the airbag responds with increased resistance but allowing increased bypass of the material 12. It is envisioned that the airbag version (or other spring like member) may be more desirable for certain operations of demolition reduction, and the latch type mechanism for other certain types of demolition reduction. It will be apparent that the shear pin release of FIGS. 1–5 may readily be incorporated into the shaft 28' of this alternate version. It will also be appreciated that the resistive forces can be varied through various adjustments or replacement of the spring members (items 65, 76, 88).

The embodiment of FIGS. 1–5 operate to unlatch, permit free bypass and then relatches and is considered desirable for certain applications of demolition reduction. FIG. 6 allows pivoting while maintaining resistance. As the reduction resistant force increases, the airbag responds with increased resistance but allowing increased bypass of the material 12. It is envisioned that the airbag version (or other biasing member) may be more desirable for certain operations of demolition reduction, and the latch type mechanism for other certain types of demolition reduction. It will be apparent that the shear pin release of FIGS. 1–5 may readily be incorporated into the shaft 28' of this alternate version. It will also be appreciated that the resistive forces can be varied through various adjustments or replacement of the biasing members (items 76 and 88)

The invention claimed is:

1. A material reduction apparatus comprising:

a rotatably mounted rotor having radial projections;

an anvil adapted to pivot into two or more positions, at least one of the positions being a closed position wherein the anvil is positioned in proximal relation to the projections of the rotor;

a conveying mechanism for conveying materials to be reduced into the rotating rotor and projections, and to be carried by said projections for impacting said anvil to reduce in size components of said materials;

a screen also adapted to pivot into two or more positions, at least one of the positions being a closed position wherein the screen is positioned in proximal relation to said projections of the rotor for engaging said components to further reduce the size of the components and to provide passage of said further reduced components through screen openings in said screen and out of the path of the projections for collection and conveyance away from said apparatus;

said anvil and screen mounted to have common pivotal movement away from said rotor projections and as pivoted away from said projections providing a bypass for materials carried by said projections to thereby avoid anvil and screen reduction; and a pivotal resist member adapted to provide a resistance to said pivotal movement while permitting said pivotal movement and thus providing said bypass of materials in response to a determined releasing force generated by reduction-resistant material, wherein the resistance when the anvil and screen are in the closed position is different from the resistance when the anvil and screen are pivoted away from the projections, the pivotal resist member further adapted to allow the screen and anvil to reestablish the closed position, wherein said pivotal resist member includes a latch mechanism and further including a cam member engaging a cam surface, said cam member being biased by a first biasing member, and said reduction by said screen and anvil urges said cam member against said first biasing member for retraction and release of said cam member in response to excessive reduction resistance and allows for reattaching once the material has bypassed.

2. A material reduction apparatus as defined in claim 1 wherein said cam surface is provided by a slidable member urged into a first slidable position in a first slidable direction by a second biasing member and a stop that prevents further movement in said first slidable direction, said cam member not urging said slidable member in said first slidable direction against said stop when said anvil and screen are urged away from said projections and said cam member urging said slidable member against said second biasing member for closing of said bypass.

3. A materials reduction apparatus comprising:

a rotatably mounted rotor having radial projections;

an anvil and at least one screen operationally fixed in proximal relation to the projections of the rotor, said anvil and screen pivotally coupled to a shaft to allow common pivotal movement away from said radial projections; and a compression member coupled to the shaft, the compression member adapted to allow limited linear movement of the shaft.

4. A material reduction apparatus as defined in claim 3, wherein said shaft is further coupled to a shear pin adapted to shear when a reduction resistant material is encountered that results in shaft movement that overcomes a predetermined amount of compression in the compression member.

5. A material reduction apparatus as defined in claim 3 further comprising a pivotal resist member adapted to provide resistance to said pivotal movement while permitting said pivotal movement in response to a determined force generated by a reduction resistant material, and further adapted to allow the anvil and screen to reestablish a closed position.

6. A materials reduction apparatus comprising:

a rotatably mounted rotor having radial projections;

an anvil and at least one screen operationally fixed in proximal relation to the projections of the rotor, said anvil and screen pivotally coupled to a shaft to allow common pivotal movement away from said radial projections; and a shear pin coupled to the shaft and adapted to shear when a reduction resistant material causes linear movement of the shaft.

7. A material reduction apparatus as defined in claim 6, wherein said shaft is further dynamically coupled to a compression member to allow limited linear movement of the shaft to allow certain reduction resistant materials to be encountered without causing the shear pin to shear.

8. A material reduction apparatus as defined in claim 6 further comprising a pivotal resist member adapted to provide resistance to said pivotal movement while permitting said pivotal movement in response to a determined force generated by a reduction resistant material, and further adapted to allow the anvil end screen to reestablish a closed position.

* * * * *

UNITED STATES PATENT AND TRADEMARK OFFICE

CERTIFICATE OF CORRECTION

PATENT NO. : 7,090,157 B2
APPLICATION NO. : 10/804781
DATED : August 15, 2006
INVENTOR(S) : Arnold Neil Peterson et al.

It is certified that error appears in the above-identified patent and that said Letters Patent is hereby corrected as shown below:

Column 3
Line 20, "...retractable cam member 60..." should read --...cam member 60...--.

Column 3
Lines 62 & 64, "...latch slide 68..." should read --...cam surface 68...--.

Column 3
Line 65, "...roller 60..." should read --...cam member 60...--.

Column 3
Line 66, "...slide 68..." should read --...cam surface 68...--.

Column 6
Line 46, "...anvil end screen..." should read --...anvil and screen...--.

Signed and Sealed this

Thirtieth Day of September, 2008

JON W. DUDAS
*Director of the United States Patent and Trademark Office*